US007669948B2

(12) United States Patent
Shin et al.

(10) Patent No.: US 7,669,948 B2
(45) **Date of Patent: *Mar. 2, 2010**

(54) FLUID EJECTOR INCLUDING A DROP SIZE SYMBOL, A METHOD OF DISPOSING A DROP SIZE SYMBOL IN A FLUID EJECTOR, AND AN IMAGE FORMING DEVICE INCLUDING A MARKING FLUID EJECTOR WITH A DROP SIZE SYMBOL

(75) Inventors: Helen Haekyung Shin, Fairport, NY (US); Peter A Torpey, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 54 days.

This patent is subject to a terminal disclaimer.

(21) Appl. No.: 12/113,458

(22) Filed: May 1, 2008

(65) Prior Publication Data

US 2008/0297547 A1 Dec. 4, 2008

Related U.S. Application Data

(62) Division of application No. 10/109,820, filed on Mar. 28, 2002, now Pat. No. 7,427,115.

(51) Int. Cl.
*B41J 29/38* (2006.01)

(52) U.S. Cl. ..... 347/5; 347/19

(58) Field of Classification Search ..... 347/5, 347/9, 14, 19, 56–59, 84–87
See application file for complete search history.

(56) References Cited

U.S. PATENT DOCUMENTS

| | | | | |
|---|---|---|---|---|
| 5,305,119 | A | 4/1994 | Rolleston et al. | |
| 5,483,360 | A | 1/1996 | Rolleston et al. | |
| 5,506,611 | A * | 4/1996 | Ujita et al. | 347/86 |
| 5,528,386 | A | 6/1996 | Rolleston et al. | |
| 5,555,461 | A | 9/1996 | Ackerman | |
| 5,594,557 | A | 1/1997 | Rolleston et al. | |
| 5,943,071 | A | 8/1999 | Premnath | |
| 6,213,582 | B1 | 4/2001 | Uchida et al. | |
| 6,318,841 | B1 | 11/2001 | Coleman et al. | |
| 6,342,830 | B1 | 1/2002 | Want et al. | |
| 6,346,884 | B1 | 2/2002 | Uozumi et al. | |
| 7,427,115 | B2 * | 9/2008 | Shin et al. | 347/5 |

* cited by examiner

*Primary Examiner*—Juanita D Stephens

(57) ABSTRACT

A fluid ejector includes a drop size symbol that is based on the fluid ejector's drop size relative to one or more fixed drop sizes. The drop size symbol is formed by comparing the fluid ejector's drop size to the one or more fixed drop sizes. An image forming device includes a marking fluid ejector that includes a drop size symbol based on the marking fluid ejector's drop size relative to one or more fixed drop sizes. The image forming device forms an image based on the drop size symbol by determining the drop size symbol and then either selecting a marking fluid look-up table based on the drop size symbol, or forming an image correction factor based on the drop size symbol.

8 Claims, 6 Drawing Sheets

FLUID EJECTOR INCLUDING A DROP SIZE SYMBOL, A METHOD OF DISPOSING A DROP SIZE SYMBOL IN A FLUID EJECTOR, AND AN IMAGE FORMING DEVICE INCLUDING A MARKING FLUID EJECTOR WITH A DROP SIZE SYMBOL

This is a divisional of U.S. application Ser. No. 10/109,820 filed Mar. 28, 2002 now U.S. Pat. No. 7,427,115 by the same inventors, and claims priority therefrom. This divisional application is being filed in response to a restriction requirement in that prior application.

CROSS-REFERENCE TO RELATED APPLICATIONS

Reference is made to commonly-assigned U.S. patent application Ser. No. 10/109,803, filed Mar. 28, 2002, now abandoned, entitled "First and second methods for an image forming device to form an image based on a drop size symbol," by Helen H. Shin and Peter A. Torpey, the disclosure(s) of which are incorporated herein.

TECHNICAL FIELD

This application relates to fluid ejectors.

BACKGROUND

Fluid ejectors are known. For example, in U.S. Pat. No. 6,318,841 to Charles P. Coleman et al., there is disclosed in FIGS. 1-3 a plurality of fluid ejectors 100, 200, 300 arranged to eject at least one fluid. The fluid may comprise, for example, marking fluid or ink. In other embodiments, the fluid may comprise any of biological fluids, medical fluids or chemical fluids.

It is known to use fluid ejectors to mark a media. For example, in the foregoing Charles P. Coleman et al. patent there is disclosed in FIGS. 12-13 a plurality of image forming devices 1200, 1300 arranged to eject at least one marking fluid on a media thus forming an image on the media. In one embodiment, the marking fluid is ink.

Other examples of fluid ejectors are discussed below.

In U.S. Pat. No. 5,555,461 to John C. Ackerman, in FIG. 1 there is depicted a printhead 12 arranged to eject ink that is supplied by ink supply 14.

In U.S. Pat. No. 5,943,071 to Karai P. Premnath there is depicted in FIG. 1 a color ink jet printer 10 comprising a color printhead 18 having a plurality of recording segments 18A, 18B, 18C and 18D each respectively connected to ink containers 20, 22, 24 and 26.

In U.S. Pat. No. 6,213,582 to Haruo Uchida et al. there is depicted in FIG. 3 an ink jet recording head 21 comprising ink jet ports 21a arranged for discharging ink droplets on a media.

It is also known to attach a radio frequency ("RF") tag to an article, the tag including stored data pertaining to the article, and to arrange a remote RF station to retrieve the stored data by RF transmission from the RF tag. For example, in U.S. Pat. No. 6,346,884 to Gakuji Uozumi et al. there is depicted in FIG. 1 an RF tag 12 attached to an article 11, the tag 12 including a memory 14f for disposing data about the article 11, the tag 12 arranged to RF transmit the stored data to a remote RF apparatus 10.

It is known for an image forming device to form an image on a media based on an input image information. One example of such an image forming device is the well-known ink jet printer that forms an image on a media by means of at least one included ink jet ejector device or printhead.

In a color imaging device, for example, the input image information comprises red ("R"), green ("G") and blue ("B") color components. The color imaging device uses one or more color look-up tables to convert, translate or transform the input RGB image information into marking fluid information. The marking fluid information, in turn, is used to control the ejection of a plurality of separate marking fluid colorants on a media to thereby form an output image on the media. Typically, the color imaging device will use four (4) individual marking colorants comprising cyan ("C"), magenta ("M"), yellow ("Y") and black ("K"). As a result, the color imaging device will use suitable color look-up tables to convert the RGB input image information to the desired output C, M, Y and K (collectively known as "CMYK") marking fluid information. Some examples of such RGB input-to-CMYK output color look-up tables are found in the following U.S. patents to Robert J. Rolleston et al.: "Color printer calibration architecture," No. 5,305,119; "Color printer calibration with blended look up tables," No. 5,483,360; and "Color printer calibration architecture," No. 5,528,386.

Image-rendering procedures, particularly the generation of color look-up tables, must be matched to the expected performance of the printheads in an ink jet printer. For example, the color look-up tables that are developed to produce the desired color rendition are often generated using a good quality ink ejector with "nominal" drop volumes for each color. In practice, however, printheads coming off the manufacturing line will produce drop size volumes that vary from printhead to printhead. If these variations are large, the resulting output from a particular printhead will appear "light" or "dark" depending on whether the ejected drops from that printhead are smaller or larger than "nominal", respectively. Thus, users may perceive differences in color rendition, print quality, or both, from printer to printer or when printheads are replaced within a printer. These rendering differences may be unacceptable for some users and some applications. For photo images on glossy media, for example, tests show that images made with 10-12 pico-liter ("pl") drops will be reasonably lighter than images produced with 12-14 pl drops.

One method of minimizing perceived variations in output due to these effects is to improve processing techniques, tighten manufacturing tolerances, or both. The goal is to produce all printheads so that their ink drop ejection characteristics, namely, drop volume or drop size, are very nearly identical so that there is no perceived difference in output produced by different printheads. Unfortunately, this approach has a disadvantage of increasing the unit manufacturing cost and lowering the yield.

Another method of minimizing perceived variations in the output from printhead to printhead is to have the user make use of special software tools such as photo editing, contrast or brightness knobs or settings inside the printer driver. These methods have the disadvantage of requiring user intervention, special software, and possibly knowledge of the printer driver, which many customers never use to change settings from default.

SUMMARY

In one aspect of the invention, there is described a fluid ejector including a drop size symbol, the fluid ejector arranged to eject at least one fluid drop of a drop size, the drop size symbol based on the drop size relative to one or more fixed drop sizes.

In a further aspect of the invention, there is described a method of disposing a drop size symbol in a fluid ejector, the fluid ejector arranged to eject at least one fluid drop of a drop size, the method comprising the steps of (a) determining the drop size; (b) comparing the drop size to one or more fixed drop sizes; (c) forming a drop size symbol based on the drop size comparing step (b); and (d) disposing the drop size symbol in the fluid ejector.

In another aspect of the invention, there is described an image forming device including a marking fluid ejector with a drop size symbol, the marking fluid ejector arranged to eject at least one marking fluid drop of a drop size on a media, the drop size symbol based on the drop size relative to one or more fixed drop sizes.

BRIEF DESCRIPTION OF THE DRAWINGS

FIG. 2 depicts a fluid ejector 100.1 including a storage means 20, the drop size symbol 3 being disposed therein;

FIG. 3 depicts a fluid ejector 100.2 comprising a radio frequency tag 30 with the drop size symbol 3 being disposed therein; and FIG. 4 depicts a fluid ejector 100.3 comprising a housing 7 having a housing exterior 8 with a drop size symbol 3 being disposed on the housing exterior 8.

DETAILED DESCRIPTION

Briefly, a fluid ejector includes a drop size symbol that is based on the fluid ejector's drop size relative to one or more fixed drop sizes. The drop size symbol is formed by comparing the fluid ejector's drop size to the one or more fixed drop sizes. An image forming device includes a marking fluid ejector that includes a drop size symbol based on the marking fluid ejector's drop size relative to one or more fixed drop sizes. The image forming device forms an image based on the drop size symbol by determining the drop size symbol and then either selecting a marking fluid look-up table based on the drop size symbol, or forming an image correction factor based on the drop size symbol.

Figure 1:
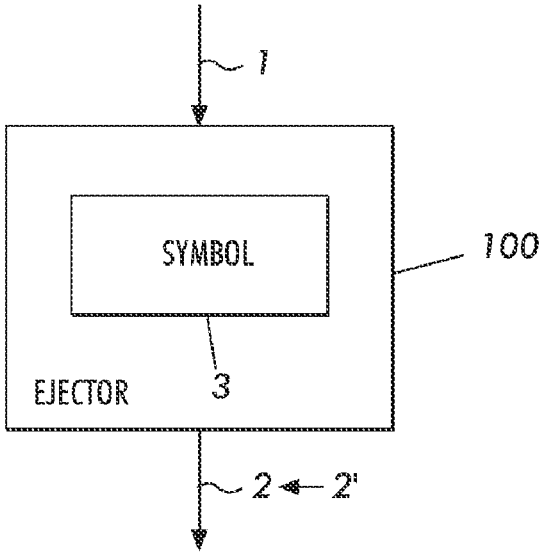
FIG. 1 depicts a fluid ejector 100 including a drop size symbol 3.

Referring now to FIG. 1, there is shown a fluid ejector 100. As shown, the fluid ejector 100 includes an input fluid information 1. The fluid ejector 100 is arranged to eject at least one fluid drop 2 based on the input fluid information 1. Each fluid drop 2 comprises a drop size 2'. Also, the fluid ejector 100 comprises a drop size symbol 3 that is based on the drop size 2' relative to one or more fixed drop sizes.

In one embodiment of the fluid ejector 100, the one or more fixed drop sizes comprises exactly four fixed drop sizes such as, for example, 10 pl, 11 pl, 13 pl and 16 pl.

In another embodiment of the fluid ejector 100, the one or more fixed drop sizes comprises exactly three fixed drop sizes such as, for example, 10 pl, 11 pl and 13 pl.

In a further embodiment of the fluid ejector 100, the one or more fixed drop sizes comprises exactly two fixed drop sizes such as, for example, 10 pl and 11 pl.

In still another embodiment of the fluid ejector 100, the one or more fixed drop sizes comprises exactly one fixed drop size such as, for example, 10 pl.

In one embodiment wherein the one or more fixed drop sizes comprises exactly one fixed drop size, the drop size symbol 3 has a first value when the drop size 2' exceeds the fixed drop size; and otherwise the drop size symbol 3 has a second value. For example, the first value might be "1" or "L" to denote that the drop size 2' is "large" relative to the fixed drop size; and the second value might be "0" or "S" to denote that the drop size 2' is "average", "not large" or "small" relative to the fixed drop size.

In another embodiment, the drop size symbol 3 has a first value when the drop size 2' does not exceed the fixed drop size; and otherwise the drop size symbol 3 has a second value. For example, the first value might be "0" or "S" to denote that the drop size 2' is "average", "not large" or "small" relative to the fixed drop size; and the second value might be "1" or "L" to denote that the drop size 2' is "large" relative to the fixed drop size.

In a further embodiment, the drop size symbol 3 has a first value when the drop size is less than the fixed drop size, the drop size symbol 3 has a second value when the drop size substantially equals the fixed drop size, and otherwise the drop size symbol 3 has a third value. For example, the first value might be "S", "1" or "01" to denote that the drop size 2' is "small" or "less than" relative to the fixed drop size; the second value might be "M", "2" or "10" to denote that the drop size 2' is "medium", "equal" or "average" relative to the fixed drop size; and the third value might be "L", "3" or "11" to denote that the drop size 2' is "large" or "greater than" relative to the fixed drop size.

In general, in accordance with the present invention, the fluid ejector 100 includes a drop size symbol 3, the fluid ejector 100 being arranged to eject at least one fluid drop 2 of a drop size 2', the drop size symbol 3 being based on the drop size 2' relative to n fixed drop sizes, where n is a positive integer whose value is equal to or greater than 1, thus, n=1, 2, 3, 4, 5, 6, 7, 8, 9, 10, . . . , etc.

In one embodiment, for example, n=6, thus yielding fixed drop size 1, fixed drop size 2, fixed drop size 3, fixed drop size 4, fixed drop size 5 and fixed drop size 6, and the drop size symbol 3 has a value that is determined by the following algorithm:

if the drop size 2' is less than the fixed drop size 1, the drop size symbol 3 has a value "A";

if the drop size 2' is equal to or greater than the fixed drop size 1 and less than the fixed drop size 2, the drop size symbol 3 has a value "B";

if the drop size 2' is equal to or greater than the fixed drop size 2 and less than the fixed drop size 3, the drop size symbol 3 has a value "C";

if the drop size 2' is equal to or greater than the fixed drop size 3 and less than the fixed drop size 4, the drop size symbol 3 has a value "D";

if the drop size 2' is equal to or greater than the fixed drop size 4 and less than the fixed drop size 5, the drop size symbol 3 has a value "E";

if the drop size 2' is equal to or greater than the fixed drop size 5 and less than the fixed drop size 6, the drop size symbol 3 has a value "F"; and if the drop size 2' is equal to or greater than the fixed drop size 6, the drop size symbol 3 has a value "G".

Figure 2:
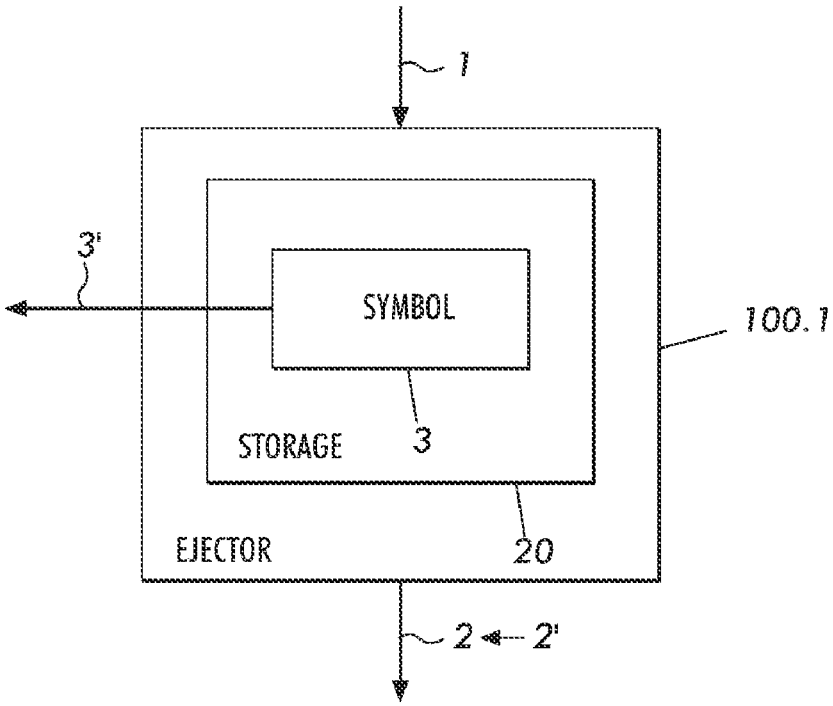
FIGS. 2-4 depict further embodiments of the FIG. 1 fluid ejector 100.
Figure 3:
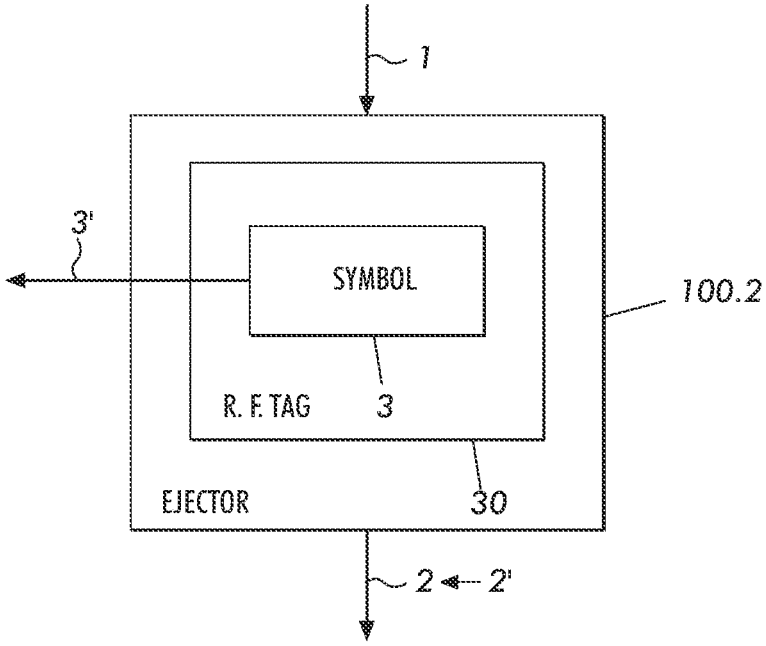
Figure 4:
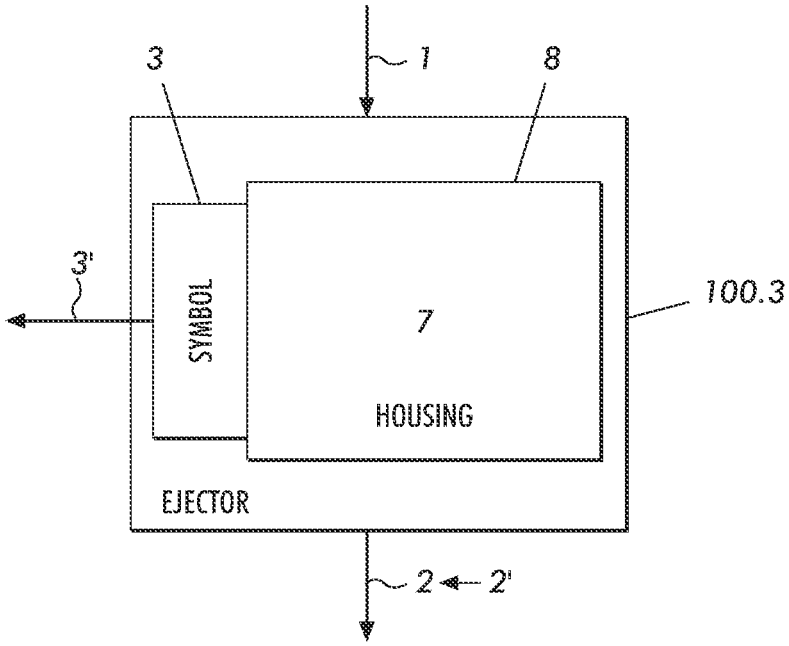

FIGS. 2-4 depict further embodiments 100.1, 100.2 and 100.3 of the FIG. 1 fluid ejector 100.

Referring to FIG. 2, in one embodiment, the fluid ejector 100.1 comprises a storage means 20 with the drop size symbol 3 being disposed therein. Depicted in FIG. 2 is the output drop size symbol 3' that has been provided by the fluid ejector. For example, the storage means 20 may comprise a typical memory device with a suitable access circuit to provide the output drop size symbol 3'.

Referring to FIG. 3, in one embodiment, the fluid ejector 100.2 comprises a radio frequency tag 30 with the drop size symbol 3 being disposed therein. Depicted in FIG. 3 is the output drop size symbol 3' that has been provided by the fluid ejector. For example, the fluid ejector 100.2 may comprise a typical radio frequency tag 12 as depicted in the foregoing U.S. Pat. No. 6,346,884 to Gakuji Uozumi et al. containing a memory **14*f* for storing the drop size symbol 3 and arranged to provide the output drop size symbol 3' by means of at least one radio frequency communication to a remote radio frequency receiver 10**.

Referring to FIG. 4, in one embodiment, the fluid ejector 100.3 comprises a housing 7 with a housing exterior 8 with the drop size symbol 3 being disposed on the housing exterior 8. Depicted in FIG. 4 is the output drop size symbol 3' that has been provided by the fluid ejector. For example, the drop size symbol 3 may be disposed on a label and the label, in turn, affixed directly to the housing exterior 8. As another example, the drop size symbol 3 may be marked directly on the surface of the housing exterior using a marking fluid such as ink. As a further example, the drop size symbol 3 may be engraved into the housing exterior 8 using a suitable cutting, grinding, or abrasive means.

Still referring to FIG. 4, in one embodiment, the drop size symbol 3 forms part of a fluid ejector identification code ("ID") or serial number. In one embodiment, the drop size symbol 3 is human-readable. In another embodiment, the drop size symbol 3 is machine-detectable by means of machine vision. For example, in one embodiment, the drop size symbol 3 comprises a bar code.

Referring now generally to the fluid ejector 100 of FIGS. 1-4, including the FIG. 2 fluid ejector 100.1, the FIG. 3 fluid ejector 100.2 and the FIG. 4 fluid ejector 100.3, in one embodiment, the fluid ejectors 100, 100.1, 100.2 and 100.3 comprise marking fluid ejectors, the input 1 comprises a marking fluid information 1 and the ejected fluid drop 2 comprises a marking fluid drop 2. In one embodiment, the marking fluid comprises ink. In another embodiment, the marking fluid comprises a colorant. In a further embodiment, the marking fluid comprises a cyan, magenta, yellow or black colorant.

In another embodiment, the fluid ejectors 100, 100.1, 100.2 and 100.3 do not comprise marking fluid ejectors, the input 1 does not comprise a marking fluid information and the ejected fluid drop 2 does not comprise a marking fluid drop. For example, in one embodiment, the ejected fluid drop 2 comprises a medicine. In another embodiment, the ejected fluid drop 2 comprises a biological fluid or solution. In a further embodiment, the ejected fluid drop 2 comprises a biomedical test result. In still another embodiment, the ejected fluid drop 2 comprises a chemical solution, such as a biomedical marker.

Figure 5:
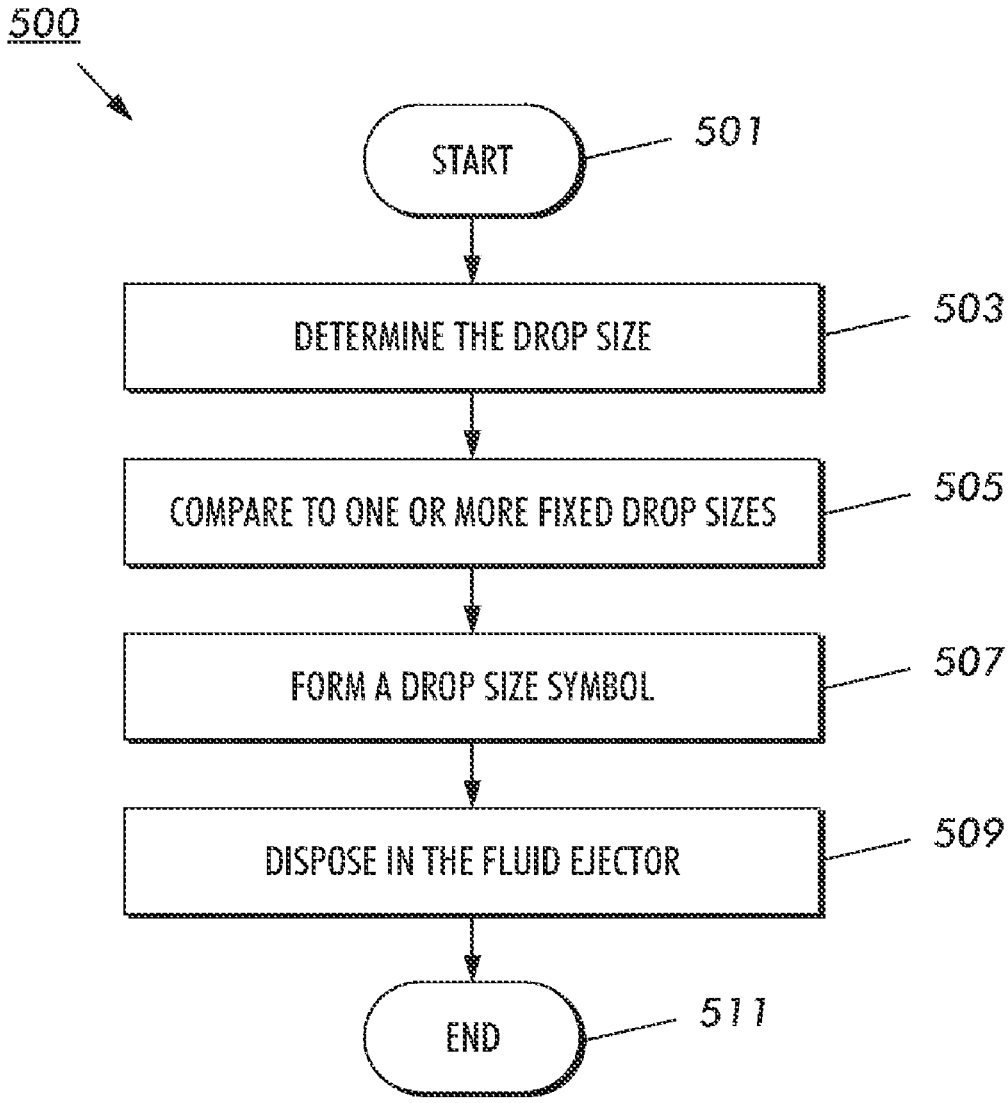
FIG. 5 depicts a flow diagram 500 of a method of disposing a drop size symbol 3 in a fluid ejector.

Referring now to FIG. 5, there is depicted a flow diagram 500 of a method of disposing the drop size symbol 3 in the fluid ejector 100. In the flow diagram 500, it is assumed that the fluid ejector 100 previously has ejected at least one fluid drop 2 of a drop size 2'.

The process starts, step 501, and then proceeds to step 503.

In step 503, the process determines the drop size 2'. The process then goes to step 505.

In step 505, the process compares the drop size 2' to one or more fixed drop sizes. The process then goes to step 507.

In step 507, the process forms a drop size symbol 3 based on the drop size comparing step 505. The process then goes to step 509.

In step 509, the process disposes the drop size symbol 3 in the fluid ejector 100.

The process then ends, step 511.

Still referring to FIG. 5, in one embodiment, the step 505 compares the drop size 2' to exactly one fixed drop size.

As discussed in connection with FIG. 2 above, in one embodiment the fluid ejector 100 comprises a storage means 20. Accordingly, in one embodiment the drop size symbol disposing step 509 includes a step of disposing the drop size symbol 3 in the storage means 20.

As discussed in connection with FIG. 3 above, in one embodiment the fluid ejector 100 comprises a radio frequency tag 30. Accordingly, in one embodiment the drop size symbol disposing step 509 includes a step of disposing the drop size symbol 3 in the radio frequency tag 30.

As discussed in connection with FIG. 4 above, in one embodiment the fluid ejector 100 comprises a housing 7 with a housing exterior 8. Accordingly, in one embodiment the drop size symbol disposing step 509 includes a step of disposing the drop size symbol 3 on the housing exterior 8.

Figure 6:
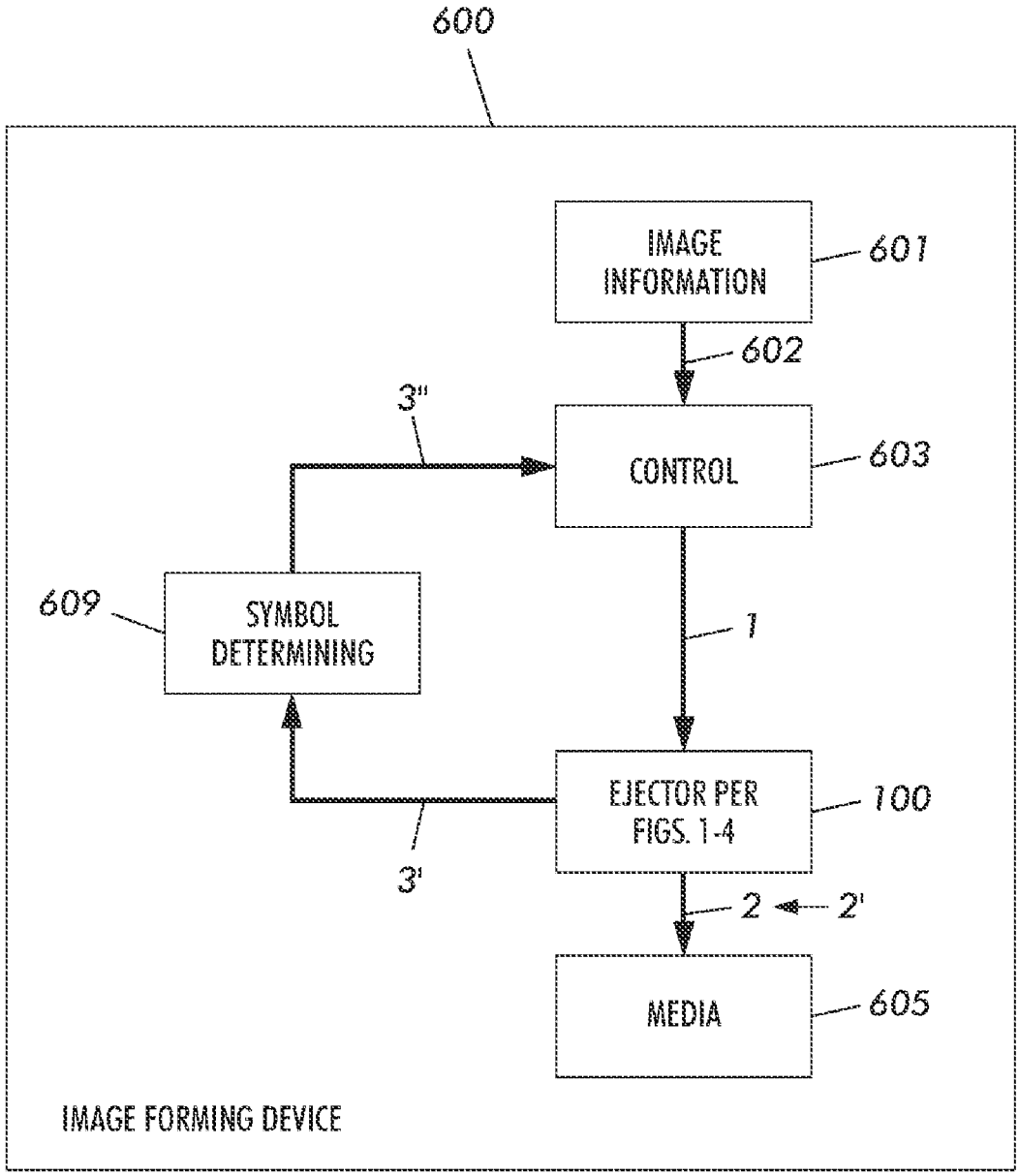
FIG. 6 depicts an image forming device 600 including a marking fluid ejector 100 with a drop size symbol 3.

Referring now to FIG. 6, there is depicted an image forming device 600 including a marking fluid ejector 100. It will be understood that the FIG. 6 marking fluid ejector 100 comprises any of the marking fluid ejectors 100, 100.1, 100.2 and 100.3 described hereinabove in connection with FIGS. 1-4. Thus, the marking fluid ejector 100 comprises a drop size symbol 3 and is arranged to eject at least one marking fluid drop 2 of a drop size 2' on a media 605, the drop size symbol 3 based on the drop size 2' relative to one or more fixed drop sizes.

Still referring to FIG. 6, in one embodiment the image forming device 600 comprises a marking fluid ejector 100 that includes a drop size symbol 3 and that is arranged to eject at least one marking fluid drop 2 of a drop size 2' on a media 605, wherein the drop size symbol 3 is based on the drop size 2' relative to exactly one fixed drop size.

As shown in FIG. 6, the image forming device comprises an image information 601 that is input 602 to a control means 603.

In one embodiment of the image forming device 600, the image information 601 comprises only monochrome information such as, for example, the well-known black and white image information; and the ejected marking fluid drop 2 comprises only a single color of ink.

In another embodiment of the image forming device 600, the image information 601 comprises plural color components such as, for example, the well-known red, green and blue or "RGB" color components; and the ejected marking fluid drops 2 comprise a plurality of different colorants such as, for example, the familiar cyan, magenta, yellow and black or "CMYK".

Based on the input image information 601, the control means 603 provides a corresponding marking fluid information 1.

In one embodiment, for example, the control means 603 contains suitable color look-up tables to convert the RGB input image information to the desired cyan, magenta, yellow and black or "CMYK" output marking fluid information.

As shown in FIG. 6, the marking fluid information 1 is input to a suitable number of marking fluid ejector units 100. For example, a typical full-color image device using the common CMYK color printing scheme will use 4 separate marking fluid ejector units, one ejector unit for each of the four C, M, Y and K colorants.

As discussed above, each marking fluid ejector 100 forms an output drop size symbol 3' based on the drop size 2' of its ejected marking fluid drop 2. As shown in FIG. 6, the image forming device 600 receives the output drop size symbol 3' and then provides this information (as depicted by the reference number 3") to the control means 603 by means of a symbol determining process 609. As described below, in one embodiment, the symbol determining process 609 is performed by the image forming device 600 itself.

Accordingly, as discussed in connection with FIG. 2 above, in one embodiment the marking fluid ejector 100 comprises a storage means 20 with the drop size symbol 3 being disposed therein. Thus, in one embodiment the drop size symbol determining means 609 is arranged to determine the drop size symbol 3 based on accessing the storage means 20 of the marking fluid ejector 100.

Further, as discussed in connection with FIG. 3 above, in one embodiment the fluid ejector 100 comprises a radio frequency tag 30 with the drop size symbol 3 being disposed therein. Thus, in one embodiment the drop size symbol determining means 609 is arranged to determine the drop size symbol 3 based on receiving at least one radio frequency communication from the marking fluid ejector 100.

Also, as discussed in connection with FIG. 4 above, in one embodiment the fluid ejector 100 comprises a housing exterior 8, with the drop size symbol 3 being disposed on the housing exterior 8. Thus, in one embodiment the drop size symbol determining means 609 is arranged to determine the drop size symbol 3 based on detecting the drop size symbol 3 by any suitable means. In one embodiment, for example, the drop size symbol 3 is machine-detectable and, accordingly, the drop size symbol determining means 606 is arranged to determine the drop size symbol by means of machine vision. In one embodiment, the drop size symbol 3 comprises a bar code and, accordingly, the drop size symbol determining means 609 is arranged to determine the drop size symbol 3 by means of a bar code detector.

In another embodiment, the symbol determining process 609 includes one or more steps by the image forming device 600's human operator or user. Thus, in one embodiment, the drop size symbol 3 is human-readable. Accordingly, in this same embodiment, the human user initially reads the drop size symbol 3 by means of her or his own human eyes and then inputs 3" the drop size symbol 3 into the control means 603 by means of a suitable input-out interface such as, for example, a keyboard, or one or more switches or keys on a control panel.

Figure 7:
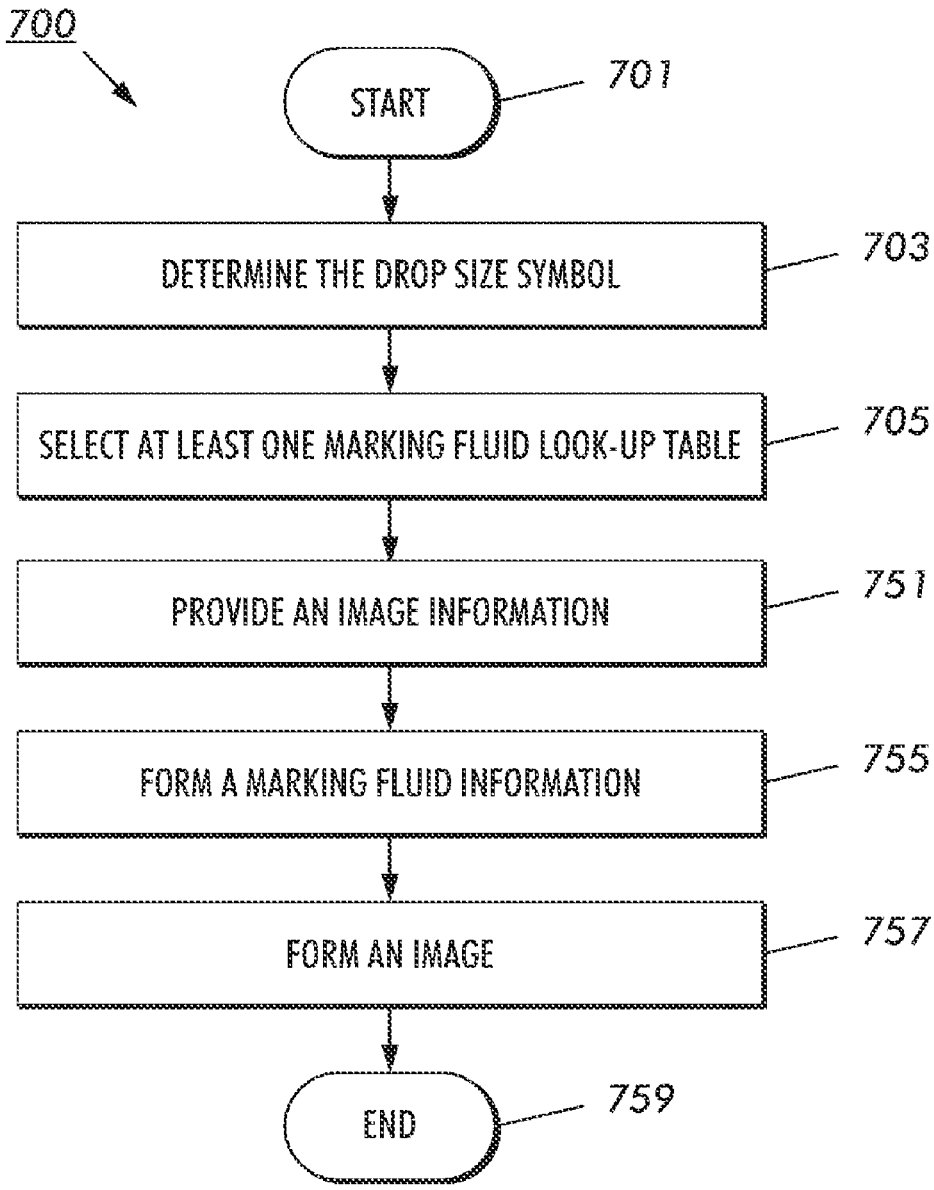
FIG. 7 depicts a flow diagram 700 of a first embodiment of a first method for an image forming device to form an image based on a drop size symbol.

Referring now to FIG. 7, there is depicted a flow diagram 700 of a first embodiment of a first method for the FIG. 6 image forming device 600 to form an image based on a drop size symbol.

In this first method, the control means 603 includes a plurality of pre-determined marking fluid look-up tables that have been generated based on the expected range of individual marking fluid ejector drop sizes 2' that correspond to the expected range of marking fluid ejector 100 units that are expected to be used by the image forming device 600. These pre-determined look-up tables are generated using prototype marking fluid ejectors whose drop sizes correspond to the values or ranges that the image forming device 600 will experienced during its operating lifetime period of use. Thus, a separate marking fluid look-up table is generated using a marking fluid ejector producing each drop size of the expected range of drop sizes, the range of drop sizes comprising, for example, "very small" drop size, "small" drop size, "average" drop size, "large" drop size, "very large" drop size, etc. Ultimately, a separate look-up table is generated and stored for each possible drop size 2' of each possible marking fluid ejector 100 unit that is to be used by the image forming device 600.

Thereafter, during installation of a particular marking fluid ejector 100 unit, the marking fluid ejector 100 unit's drop size 2' is determined by, first, reading the drop size symbol 3 of the marking fluid ejector 100 unit and then, second, translating or converting the drop size symbol 3 to the corresponding drop size 2' of the marking fluid ejector 100 unit. The marking fluid ejector 100 unit's drop size 2' then is used to select a matching pre-determined look-up table that is stored in the control means 603 to provide an optimal image output for the drop size 2' of the current marking fluid ejector 100 being used. As a result, the optimal marking fluid look-up table is selected for use with the particular marking fluid ejector 100 unit that is currently being used by the image forming device 600.

The process starts in FIG. 7 at step 701, and then proceeds to step 703.

In step 703, the process determines the drop size symbol 3 by any convenient method including, for example, by those methods described above in connection with the FIG. 6 symbol determining process 609.

For example, with momentary reference back to FIG. 2, the marking fluid ejector 100.1 shown therein comprises a storage means 20 with the drop size symbol 3 disposed therein. Thus, in one embodiment, the present drop size symbol determining step 703 includes a step of accessing the storage means 20.

Further, with momentary reference back to FIG. 3, the fluid ejector 100.2 shown therein comprises a radio frequency tag 30 with the drop size symbol 3 disposed therein. Thus, in one embodiment, the present drop size symbol determining step 703 includes a step of detecting at least one radio frequency communication from the radio frequency tag 30.

Also, with momentary reference back to FIG. 4, the fluid ejector 100.3 shown therein comprises a housing exterior 8 with the drop size symbol 3 disposed thereon. In one embodiment, the drop size symbol 3 is machine-detectable and the present drop size symbol determining step 703 includes a step of detecting the drop size symbol 3 by means of machine vision. In another embodiment, the present drop size symbol determining step 703 includes a step of the human operator or user reading the drop size symbol 3 by means of human eyes. In a further embodiment, the drop size symbol 3 forms part of a marking fluid ejector identification code ("ID").

The process then goes to step 705.

In step 705, the process selects at least one marking fluid look-up table based on the drop size symbol, thus forming a selected at least one marking fluid look-up table.

In one embodiment, this step 705 selects only one marking fluid look-up table. This first embodiment corresponds to an image forming device 600 using only a monochrome image information such as black-and-white to form an image using only a single color of marking fluid, such as black. In another embodiment, this step 705 selects multiple fluid look-up tables. This second embodiment corresponds to an image forming device 600 using multi-color image information such as RGB to form an image using multiple colors of marking fluid, such as CMYK. The process then goes to step 751 of FIG. 7.

In step 751, the process provides an image information 601. In one embodiment, the image information 601 comprises at least one of a red (R), green (G) and blue (B) image information. The process then goes to step 755.

In step 755, the process forms a marking fluid information 1 based on the image information 601 and the selected at least one marking fluid look-up table from step 705.

In one embodiment, the marking fluid information 1 comprises at least one of a cyan (C), magenta (M), yellow (Y) and black (K) colorant information.

With momentary reference back to FIG. 6, as depicted therein, it will be understood that this step 755 also includes a step of providing the marking fluid information 1 to the one or more marking fluid ejector 100 units. The process then goes to step 757.

In step 757, the process forms an image 2 based on the marking fluid information. With momentary reference back to FIG. 6, as depicted therein, the one or more marking fluid ejector 100 units form an image by ejecting drops of marking fluid 2 on the media 605.

The process ends, step 759.

Figure 8:
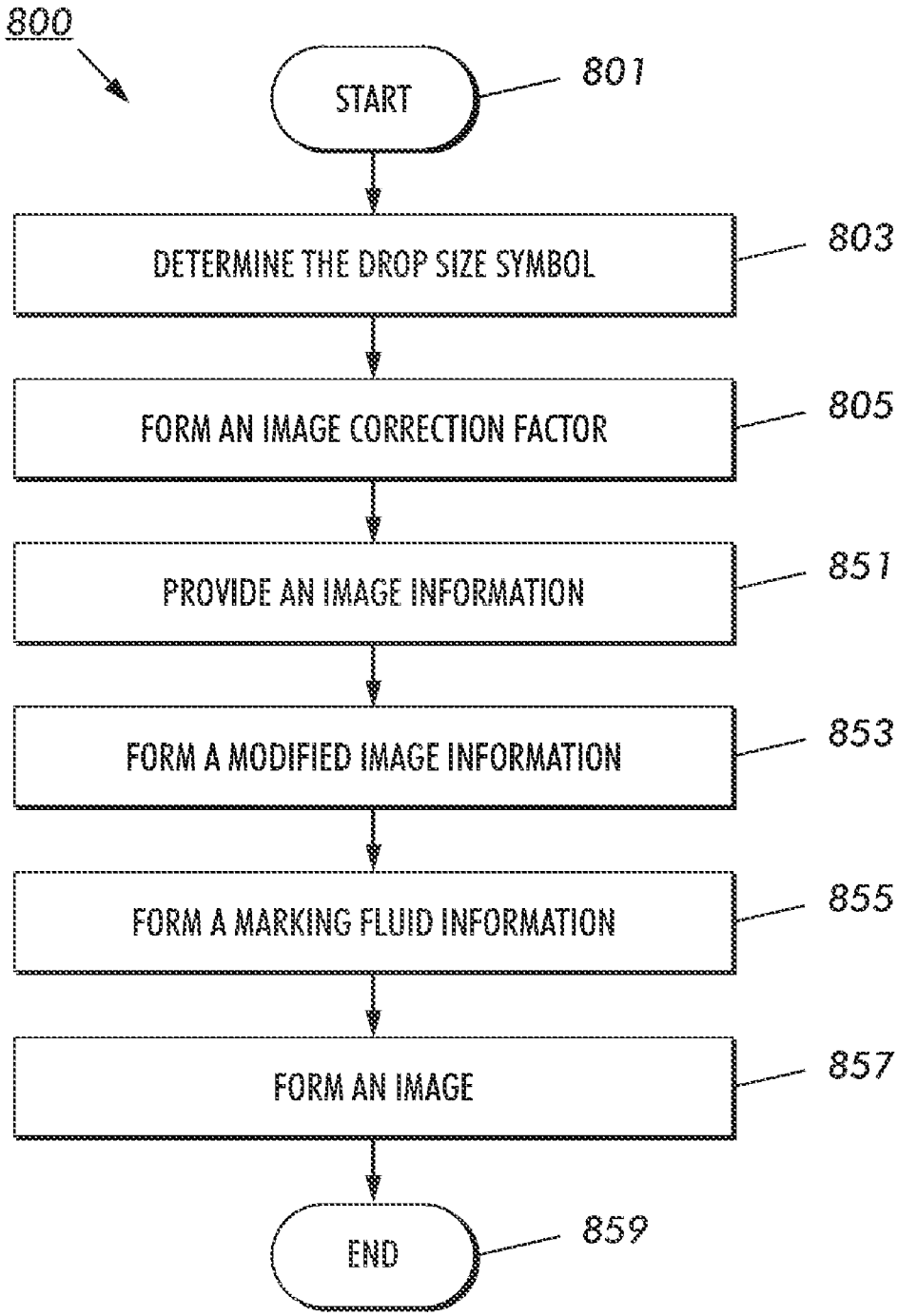
FIG. 8 depicts a flow diagram 800 of a first embodiment of a second method for an image forming device to form an image based on a drop size symbol.

Referring now to FIG. 8, there is depicted a flow diagram 800 of a first embodiment of a second method for the FIG. 6 image forming device 600 to form an image based on a drop size symbol.

In this second method, the marking fluid ejector 100 unit's drop size 2', as determined by the process of detecting and translating the marking fluid ejector 100 unit's corresponding drop size symbol 3, is used to form an image correction factor that is then used to modify the "lightness/darkness" of the image information. After modifying the image information with the image correction factor, the resulting modified image information is then input to only one color look-up table. In other words, the idea is to modify the image information RGB values based on the marking fluid ejector 100 drop size 2' (as derived from the drop size symbol 3) before the single color look-up table is used. If the ejector 100 drop size 2' is less than the normal drop size, the correction factor will be greater than 1 thus making the input image darker. Conversely, if the ejector 100 drop size 2' is greater than the normal drop size, the correction factor will be less than 1 thus making the input image lighter. In one embodiment, the correction factor can be related as a lightness/darkness slider and thus implemented into the printer driver.

The process starts in FIG. 8 at step 801, and then proceeds to step 803.

In step 803, the process determines the drop size symbol 3 by any convenient method including, for example, by those methods described above in connection with the FIG. 6 symbol determining process 609.

For example, with momentary reference back to FIG. 2, the marking fluid ejector 100.1 shown therein comprises a storage means 20 with the drop size symbol 3 disposed therein. Thus, in one embodiment, the present drop size symbol determining step 803 includes a step of accessing the storage means 20.

Further, with momentary reference back to FIG. 3, the fluid ejector 100.2 shown therein comprises a radio frequency tag 30 with the drop size symbol 3 disposed therein. Thus, in one embodiment, the present drop size symbol determining step 803 includes a step of detecting at least one radio frequency communication from the radio frequency tag 30.

Also, with momentary reference back to FIG. 4, the fluid ejector 100.3 shown therein comprises a housing exterior 8 with the drop size symbol 3 disposed thereon. In one embodiment, the drop size symbol 3 is machine-detectable and the present drop size symbol determining step 803 includes a step of detecting the drop size symbol 3 by means of machine vision. In another embodiment, the present drop size symbol determining step 803 includes a step of the human operator or user reading the drop size symbol 3 by means of human eyes. In a further embodiment, the drop size symbol 3 forms part of a marking fluid ejector identification code ("ID").

The process then goes to step 805.

In step 805, the process forms an image correction factor based on the drop size symbol 3. The process then goes to step 851 of FIG. 8.

In step 851, the process provides an image information 601. In one embodiment, the image information 601 comprises at least one of a red (R), green (G) and blue (B) image information. The process then goes to step 853.

In step 853, the process forms a modified image information based on the image correction factor that was formed in step 805 and the image information provided in step 851. In one embodiment, the modified image information is formed by multiplying the image correction factor by the image information. The process then goes to step 855.

In step 855, the process forms a marking fluid information 1 based on the modified image information formed in step 853. In one embodiment, the marking fluid information 1 is formed by applying the modified image information to a single color look-up table.

In one embodiment, the marking fluid information 1 comprises at least one of a cyan (C), magenta (M), yellow (Y) and black (K) colorant information.

With momentary reference back to FIG. 6, as depicted therein, it will be understood that this step 855 also includes a step of providing the marking fluid information 1 to the one or more marking fluid ejector 100 units. The process then goes to step 857.

In step 857, the process forms an image 2 based on the marking fluid information 1. With momentary reference back to FIG. 6, as depicted therein, the one or more marking fluid ejector 100 units form an image by ejecting drops of marking fluid 2 on the media 605.

The process then goes to step 859.

In step 859, the process ends.

Still referring to FIG. 8, the instant method as depicted by the flow diagram 800 improves memory requirements as compared to the previous method depicted by the flow diagram 700 as the instant method uses only a single color look-up table and thus obviates the need for multiple color look-up tables, that is, one table for each drop size. Further, in the instant method depicted by the flow diagram 800, the image correction factor is set for the particular drop size 2' of the marking fluid ejector 100. By using this instant method, various marking fluid ejectors with various drop sizes 2' and drop size parameters 3 still produce approximately the same image results. This approach has been successfully demonstrated in producing quality photo images with minimal image variations over a large range of ejector 100 marking fluid drop size 2' variations.

In summary, a fluid ejector 100 ejects a fluid drop 2 of drop size or volume 2'. The drop size 2' is measured at the factory and represented by a drop size symbol 3 that is based on the drop size 2' relative to one or more fixed drop sizes. In one embodiment, the drop size symbol 3 is based on the drop size 2' relative to exactly one fixed drop size. The drop size symbol 3 is disposed in the fluid ejector 100. In one embodiment, the drop size symbol 3 is encoded into the fluid ejector 100 unit's identification code or serial number. In one embodiment, the fluid ejector 100 ejects marking fluid, or ink, and is known as a marking fluid ejector 100, ink jet printhead or ink jet cartridge. In one embodiment, a marking fluid ejector 100 unit's drop size symbol 3 is used by a host image forming device to modify the image forming device's image forming process to match, compensate or optimize for the marking fluid ejector 100 unit's fluid drop size 2'. In one embodiment, an image forming process (depicted in the flow diagram 700) selects a different stored color look-up table based on the drop size symbol 3. In another embodiment, an image forming process (depicted in the flow diagram 800) modifies the input image information based on the drop size symbol 3.

While various embodiments of a fluid ejector including a drop size symbol, a method of disposing a drop size symbol in a fluid ejector, and an image forming device including a marking fluid ejector with a drop size symbol have been described hereinabove, the scope of the invention is defined by the following claims. It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. A fluid ejector (100.1) arranged to eject a fluid drop (2), the fluid drop (2) comprising a drop size (2'), the fluid ejector (100.1) comprising a storage means (20), the storage means (20) having a drop size symbol stored therein, thus forming a stored drop size symbol (3), the stored drop size symbol (3) having a value that is based on comparing (505) the drop size (2') to n fixed drop sizes, where n is a positive integer whose value is equal to or greater than 1.

2. The fluid ejector of claim 1 arranged so that an imaging forming device (FIG. 6, reference number 600) including the fluid ejector is thus enabled to form an image on a media (605) by means of the included fluid ejector and based on any of a first method (FIG. 7, reference number 700) and a second method (FIG. 8, reference number 800), the first method (FIG. 7, reference number 700) comprising the steps of:

(a) (FIG. 7, step 703) determine the stored drop size symbol value;

(b) (FIG. 7, step 705) select at least one marking fluid look-up table based on the stored drop size symbol value, thus forming a selected at least one marking fluid look-up table;

(c) (FIG. 7, step 751) provide an image information;

(d) (FIG. 7, step 755) form a marking fluid information based on the image information and the selected at least one marking fluid look-up table; and (e) (FIG. 7, step 757) form an image based on the marking fluid information;

where the image forming device (FIG. 6, reference number 600) comprises a plurality of marking fluid look-up tables based on a range of marking fluid drop sizes; and the second method (FIG. 8, reference number 800) comprising the steps of:

(a) (FIG. 8, step 803) determine the stored drop size symbol value;

(b) (FIG. 8, step 805) form an image correction factor based on the stored drop size symbol value;

(c) (FIG. 8, step 851) provide an image information;

(d) (FIG. 8, step 853) form a modified image information based on the image correction factor and the image information;

(e) (FIG. 8, step 855) form a marking fluid information based on the modified image information; and (f) (FIG. 8, step 857) form an image based on the marking fluid information.

3. The fluid ejector of claim 1, wherein n equals 1.

4. The fluid ejector of claim 3, the stored drop size symbol having a first value when the drop size exceeds the fixed drop size, otherwise a second value.

5. The fluid ejector of claim 3, the stored drop size symbol having a first value when the drop size does not exceed the fixed drop size, otherwise a second value.

6. The fluid ejector of claim 3, the stored drop size symbol having a first value when the drop size is less than the fixed drop size, a second value when the drop size substantially equals the fixed drop size, otherwise a third value.

7. The fluid ejector of claim 1, the stored drop size symbol forming part of an identification code or serial number.

8. The fluid ejector of claim 1, the fluid comprising a marking fluid.

* * * * *